United States Patent [19]

Frechette

[11] 3,943,869

[45] Mar. 16, 1976

[54] SUBMARINE BOAT

[76] Inventor: Jean-Paul Frechette, 350-6th Ave., LaSalle, Quebec, Canada

[22] Filed: Jan. 21, 1975

[21] Appl. No.: 542,660

[30] Foreign Application Priority Data

Feb. 21, 1974 Canada ..... 193163

[52] U.S. Cl. ..... 114/16 E

[51] Int. Cl.[2] ..... B63G 8/00

[58] Field of Search..... 114/16 R, 16 A, 16 E, 16 F, 114/.5 T, 121, 125; 9/4 R; 115/25, 26.3, 28 A, 31

[56] References Cited

UNITED STATES PATENTS

| | | | |
|---|---|---|---|
| 399,693 | 3/1889 | Poore et al. | 114/16 E |
| 1,382,073 | 6/1921 | Fort | 114/16 E |
| 1,579,109 | 3/1926 | Haseley | 114/16 E |
| 2,599,791 | 6/1952 | Swenson | 115/31 |
| 3,689,953 | 9/1972 | Markakis | 114/125 |

FOREIGN PATENTS OR APPLICATIONS

| | | | |
|---|---|---|---|
| 443,199 | 11/1934 | United Kingdom | 114/16 E |
| 1,240,629 | 8/1960 | France | 115/31 |

*Primary Examiner*—Trygve M. Blix
*Assistant Examiner*—Jesus D. Sotelo

[57] ABSTRACT

A submarine boat of the engineless type wherein the propulsion and vertical displacement thereof are distinctively obtained by cooperatively changing the longitudinal angle of inclination or pitch attitude and the buoyancy thereof. This submarine boat includes an elongated shell having apertures allowing water in and out thereof, an air-tight cabin, a pair of bellows extending lengthwise longitudinally of the shell and each having an open end communicating with the cabin, hydraulic cylinders extending into the bellows and connected to the other end of the latter respectively, and separate two-way valves connected to the hydraulic cylinders respectively to selectively actuate the latter, thereby producing selective expansion or contraction of the bellows.

6 Claims, 3 Drawing Figures

SUBMARINE BOAT

This invention relates to a submarine boat and, more particularly, to a submarine boat of the engineless type.

A submarine device of the above type has anteriorly been proposed wherein the propulsion is said to be produced by taking on water at the front or expelling water at the rear, both to change the attitude of the device and impart forward propulsion thereto. Obviously, with this anterior concept, the propulsion essentially relies on pumping water in at the front and out at the rear in association with a change of attitude of the device. There results a relatively complex system with inherent maintenance and operation disadvantages.

It is a general object of the present invention to provide a submarine boat of the above type with a simple propulsion system wherein the propulsion is achieved by a mere change of longitudinal attitude of the submarine boat and the use of simple expandible and contractible devices.

It is a more specific object of the invention to provide a submarine boat of the above type with an elongated gliding shell, a pair of bellows into the latter and hydraulic cylinder and piston units selectively actuatable to expand and contract the bellows, thereby changing the longitudinal angle of inclination or pitch attitude and producing a resultant rising or sinking glide of the submarine boat.

The above and other objects and advantages of the invention will be better understood in the light of the following detailed description of a preferred embodiment thereof, which is illustrated, by way of example, in the accompanying drawings, wherein.

Figure 1:
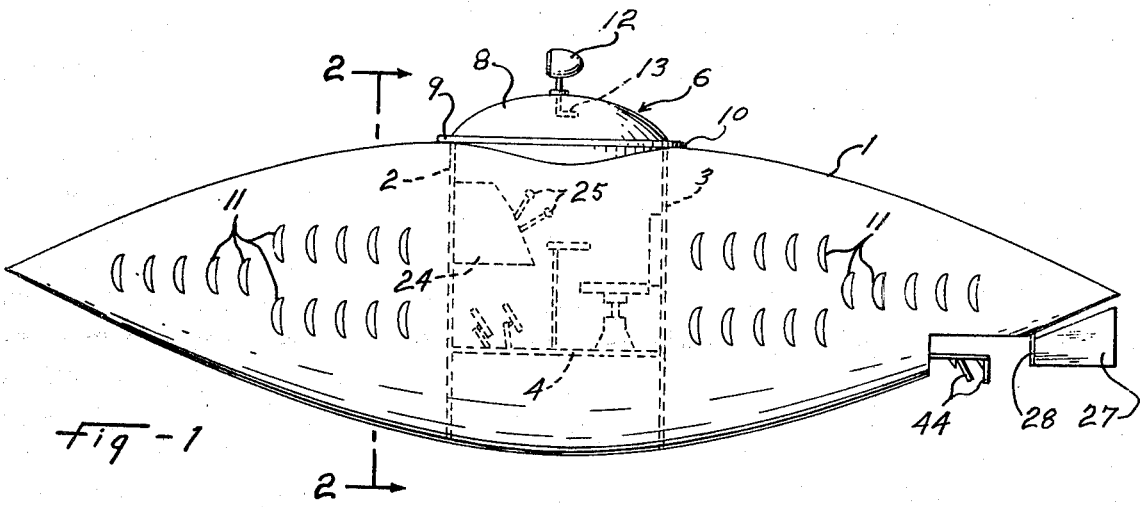
FIG. 1 is a lateral view of a submarine boat according to the invention.
Figure 2:
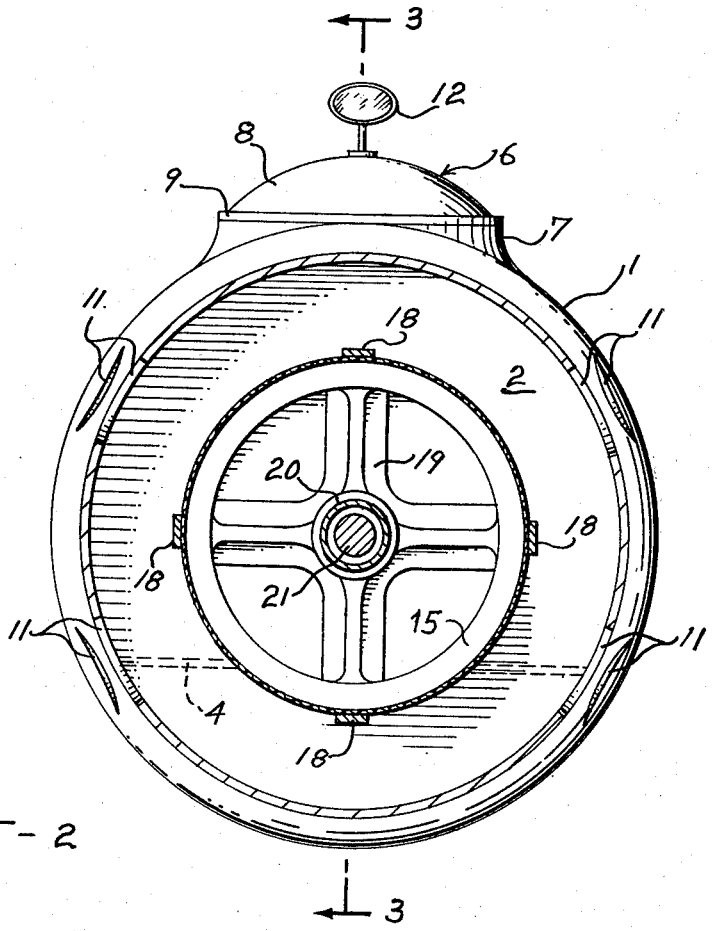
FIG. 2 is a transverse cross-sectional view as seen along line 2—2 in FIG. 1.
Figure 3:
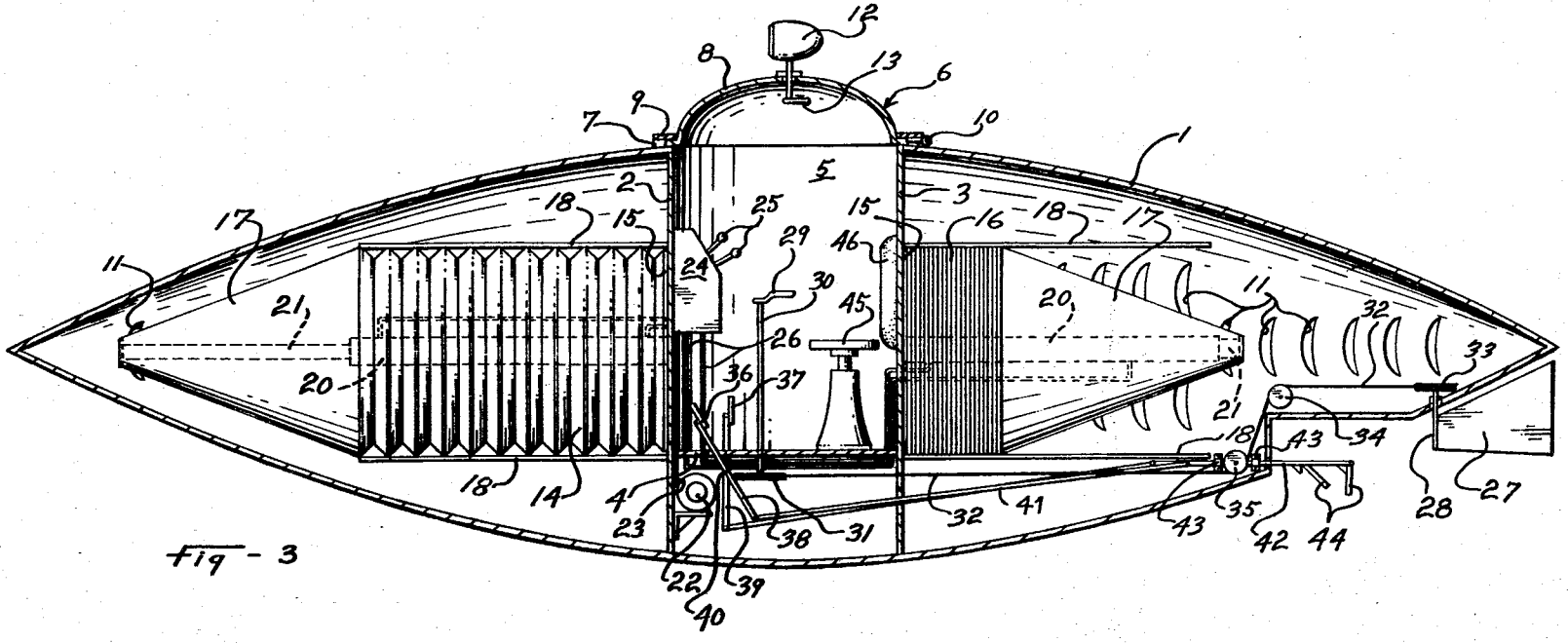
FIG. 3 is a longitudinal elevation view of the same submarine boat showing the shell thereof in longitudinal cross-section to reveal the internal parts.

The illustrated submarine boat includes an outer shell 1, of elongated shape, forming outwardly reducing or tapering opposite front and rear ends. A pair of annular rigid partitions 2 and 3 are circumferentially secured air tight against the inner wall of the shell 1 in parallel spaced-apart relationship along the length of the submarine. A floor panel 4 is peripherally secured air tight to the opposite lateral sides of the shell 1 and to the annular rigid partitions 2 and 3. Thus, the floor panel 4 is of rectangular planar contour and defines a cabin forming a cabin space 5 with the partitions 2 and 3 and the opposite lateral sides of the shell 1.

Access into or exit from the cabin space 5 is obtained through a hatch 6 overlying the cabin space. The shell 1 has a central top opening surrounded by an annular rim 7 having a flat top suface. A cupola 8 is secured air tight to an annular frame 9 and the latter is pivoted at 10, in any suitable manner, to allow opening and closing of the hatch 6. The cupola 8 is preferably formed of transparent material, such as glass or transparent plastics. A handle and a latch, of any appropriate and known types, may form part of the hatch 6 to conveniently open and tightly close the latter.

Water inlet and outlet apertures 11 are provided into the wall of the shell 1, allowing free passage of water in and out of the latter. A light 12, suitable for marine use, is swivelly mounted on the cupola 8 and is rotated from the inside by a handle 13, or any other suitable expedient, such as the search-lights now installed on vehicles and, in particular, on police cars.

A front bellows 14 is secured endwise by a ring 15 against the forward face of the annular rigid partition 2 and projects forwardly of the latter, longitudinally of the shell 1. Similarly, a rear bellows 16 is secured endwise by a ring 15 against the rear face of the annular rigid partition 3 and projects rearwardly of the latter, longitudinally of the shell 1. Thus, the pair of bellows 14 and 16 are aligned with the central apertures of the annular partitions 2 and 3 and allow free air circulation from one bellows to the other passing by the cabin chamber 5. A hollow conical member 17 has its open larger end secured air tight to the outer end of each bellows 14 and 15 and projects in alignment therewith. Guide bars 18 are secured endwise and rigidly against the outer face of each annular partition 2 and 3 and extend lengthwise of the corresponding bellows adjacent the periphery thereof to laterally guide the same. A rigid abutment member, or cruciform plate 19, is secured to each annular partition 2 and 3 and extends across the central aperture thereof. A hydraulic cylinder and piston unit extend axially into each bellows and includes a hydraulic cylinder 20 having its closed end abutting against the corresponding abutment plate 19 and a piston 21 abutting at its free end against the corresponding conical member 17 into the apex thereof.

A pump 22, driven by an electric motor and a battery, not shown, supplies compressed hydraulic fluid to a line 23. The latter is connected to a pair of two-way valves, of any suitable type, mounted into the control box 24 and actuated by control levers 25 respectively. Each of the two valves is connected by a pair of hydraulic fluid lines 26 to the opposite ends of the corresponding cylinder 20.

A rudder 27 is pivotally mounted by an upright pivot 28 under the rear of the submarine boat. A handle bar 29 is fixed to the upper end of a steering post 30 having a pulley 31 secured to the lower end thereof under the floor panel 4. A steering cable 32 is looped around the pulley 31, a pulley 33 on the upper end of the pivot 28 and auxiliary pulleys 34, 35.

A pair of pedals 36 and 37 are pivotally connected to the upper end of a pair of pedal arms 38 and 39 which are pivoted on a transverse pin or rod 40. A pair of push rods 41 are pivotally connected at their front end to the lower end of the pedal arms 38, 39 and at their rear end to sliding rods 42 carried by brackets 43. The rods 42 slidably project outwardly through the wall of the shell 1 and have each a pedal unit connected thereto and including flaps 44. The latter are arranged, as is well known, to provide forward propulsion upon fore and aft reciprocal sliding of the rods 42.

A seat 45, of adjustable height, is provided into the cabin chamber 5 and a padded back-rest 46 is secured against the rear partition 3.

To submerge the submarine, the bellows must be actuated to provide both the required weight or density for sinking and a nose-down attitude or inclination. This is produced by fully contracting the front bellows 14 and partly the rear bellows 16. Thus, the submarine starts to sink with the front slightly lower than the rear. The submarine then starts to glide forwardly and downwardly. The process is reversed and, thus, the center of floatation is shifted rearwardly, causing the submarine to glide forwardly and upwardly. When rising, the sum of the effective volumes of the bellows is caused to be increased to increase floatation by proper control of the bellows as above.

When at rest, one can use pedals 36 and 37 for a slight displacement.

The repeated lowering and raising, as aforementioned, produce up and down advances. Obviously, the submarine can move in reverse in the same manner.

What I claim is:

1. A submarine boat comprising an elongated apertured shell defining a front end and a rear end, an airtight cabin located in said elongated shell intermediate said front end and said rear end, a pair of expandible and contractible bellows extending longitudinally of and inside said shell on opposite sides of said cabin respectively, each of said bellows having one end secured endwise to said cabin in communication therein, and each being longitudinally expandible and contractible toward and away from said cabin and said one end, and hydraulic piston means connected to said expandible and contractible bellows and adapted to selectively expand and contract the latter.

2. A submarine boat as defined in claim 1, wherein said hydraulic piston means includes a pair of hydraulic cylinder and piston units extending longitudinally axially inside said bellows respectively.

3. A submarine boat as defined in claim 2, wherein each of said bellows has said one end open and in communication with said cabin and each of said hydraulic cylinder and piston units is fixed at the opposite ends thereof to said cabin at said one end of the corresponding bellows and to the other end of the latter respectively.

4. A submarine boat as defined in claim 3, wherein said front end and said rear end are tapering away from each other and said shell has apertures therethrough allowing passage of water in and out of said shell upon selective expansion and contraction of said bellows.

5. A submarine boat as defined in claim 4, further including articulated paddling fins exteriorly connected to said shell and pedals mounted in said cabin and connected to said paddling fins for actuation thereof.

6. A submarine boat as defined in claim 5, further including a pump, conduits connecting said pump to said hydraulic cylinder and piston units, and a pair of manual two-way control valves connected to said conduits in association with said hydraulic cylinder and piston units respectively and selectively operable for actuation of the latter.

* * * * *